US005642784A

United States Patent [19]

Guay et al.

[11] Patent Number: 5,642,784

[45] Date of Patent: Jul. 1, 1997

[54] EXHAUST HOOD APPARATUS

[75] Inventors: Christian Guay, Quebec; Guy Leblond, Ste-Claire, both of Canada

[73] Assignee: Sani Metal Ltd., Canada

[21] Appl. No.: 604,498

[22] Filed: Feb. 21, 1996

[51] Int. Cl.[6] ..... A62C 3/00

[52] U.S. Cl. ..... 169/61; 169/65

[58] Field of Search ..... 169/61, 65

[56] References Cited

U.S. PATENT DOCUMENTS

| | | | |
|---|---|---|---|
| 3,584,688 | 6/1971 | Duncan et al. | 169/65 |
| 3,865,193 | 2/1975 | Hall | 169/65 |
| 4,066,064 | 1/1978 | Vandas | 169/65 |
| 4,084,947 | 4/1978 | Ear . | |
| 4,085,735 | 4/1978 | Kaufman et al. . | |
| 4,267,889 | 5/1981 | Williams | 169/61 |
| 4,483,316 | 11/1984 | Fritz et al. . | |
| 4,675,541 | 6/1987 | Peters et al. | 169/65 |
| 4,784,114 | 11/1988 | Muckler et al. . | |
| 4,785,725 | 11/1988 | Tate et al. | 169/65 |
| 4,903,685 | 2/1990 | Melink . | |
| 5,074,281 | 12/1991 | Fluhrer et al. . | |
| 5,125,458 | 6/1992 | Berman | 169/61 |
| 5,139,009 | 8/1992 | Walsh . | |
| 5,232,152 | 8/1993 | Tsang . | |
| 5,351,760 | 10/1994 | Tabor | 169/65 |

FOREIGN PATENT DOCUMENTS

| | | | |
|---|---|---|---|
| 62999 | 5/1977 | Japan | 169/61 |
| 2 203 828 | 4/1987 | United Kingdom . | |

*Primary Examiner*—Gary C. Hoge

[57] ABSTRACT

An exhaust hood apparatus, adapted to be mounted over a cooking station for expelling air containing cooking by-products, is described herein. The exhaust hood apparatus includes a controller circuit electrically connected to at least a temperature sensor, an exhaust fan and a plenum chamber washing system. The controller circuit is configured so as to energize the exhaust fan and the washing system if the temperature sensor detects a temperature that is above a predetermined threshold, indicating an uncontrolled fire in progress. A portion of the water exiting the washing system is therefore drawn in the exhaust duct by the exhaust fan to thereby cool the exhaust duct and maintain it below a predetermined safety temperature. Furthermore, the exhaust fan also draws at least some of the smoke generated by the uncontrolled fire.

26 Claims, 3 Drawing Sheets

EXHAUST HOOD APPARATUS

FIELD OF THE INVENTION

The present invention relates to exhaust hood apparatuses. More specifically, the present invention relates to an exhaust hood apparatus including a controller for controlling its operation.

BACKGROUND OF THE INVENTION

The prior art is replete with exhaust hood apparatuses, mountable above a cooking station, and which primary functions are to draw air containing cooking by-products from the immediate vicinity of the cooking station and to expel this contaminated air to an external environment through an exhaust duct.

Since part of the cooking by-products is formed by minute particles of grease that have a tendency to stick to the plenum chamber of the exhaust hood, many exhaust hood apparatuses include a system to wash the plenum chamber and the exhaust duct periodically.

These washing systems typically include a valve assembly provided between a hot water source and an outlet nozzle mounted in the plenum chamber. A timer is often used to create a wash cycle by opening the valve assembly for a predetermined period.

To conform with known safety rules, conventional exhaust hood apparatuses usually include a safety mechanism designed to prevent the propagation of fires through the exhaust ducts linking the exhaust hood to an external environment. This safety mechanism is intended to prevent the temperature of the exhaust duct to exceed a predetermined maximum level which is called the flash point. The flash point in a plenum chamber or an exhaust duct varies with the level of contamination of the walls of the plenum chamber and of the exhaust duct. Indeed, the flash point decreases with the increase of grease or other particles sticking to these walls.

It is therefore imperative that the temperature in the plenum chamber and in the exhaust ducts stays below the flash point to eliminate the risks of fire propagation through the exhaust ducts.

One common safety mechanism consists of a damper that is automatically closed when abnormally elevated temperatures are detected in or near the exhaust duct. For example, U.S. Pat. No. 4,784,114 issued on Nov. 15, 1988 to Muckler et al. describes a kitchen ventilating system including a damper that is closed by automatically initiating the operation of a motor when a predetermined heat level is detected by a temperature sensor. The ventilating system proposed by Muckler also includes a spray wash apparatus operated by a control circuit. The spray wash apparatus is activated when a predetermined heat level is detected by a temperature sensor. However, if the fire producing the heat level detected by the temperature sensor is not inside the enclosure of the ventilating apparatus, the water exiting the spray wash apparatus will not assist to extinguish it since the damper is closed and therefore prevents the water to exit the ventilating apparatus. Another disadvantage of the ventilation system of Muckler is the fact that the smoke generated by an eventual fire may not be exhausted since the damper is closed.

U.S. Pat. No. 4,085,735 issued on Apr. 25, 1978 to Kaufman et al. describes an air ventilation and washing system having automatically activated electrical and mechanical fire control apparatus selectively responsive to changes in temperature in an exhaust duct of the ventilation system. The washing system is mounted inside the exhaust duct and is automatically activated should a temperature sensor detect a heat level that is above a predetermined threshold.

The system proposed by Kaufman is designed to extinguish the uncontrolled fire, not to cool the exhaust duct. Indeed, the water supplied to the washing system is hot, decreasing its efficiency to cool the exhaust duct.

Another disadvantage of the system proposed by Kaufman is that the washing system has conduits and water outlets along the entire length of the exhaust duct. However, most of the grease tends to accumulate in the plenum chamber, near the inlet of the exhaust duct. The water outlets away from the duct inlet are therefore not necessary for cleaning purposes. Furthermore, since ventilation systems are often mounted away from the external outlet of the exhaust duct, the cost involved in the installation of the washing system over the entire length of the duct increases significantly the total cost of the ventilation system.

Yet another disadvantage of the ventilation system of Kaufman is the fact that there is no provision to exhaust the smoke generated by an eventual fire.

OBJECTS OF THE INVENTION

An object of the present invention is therefore to provide an improved exhaust hood apparatus.

Another object of the present invention is to provide an exhaust hood apparatus preventing fire propagation through the exhaust duct of the exhaust hood.

SUMMARY OF THE INVENTION

More specifically, in accordance with the present invention, there is provided an exhaust hood apparatus for use at a cooking station for exhausting air containing cooking by-products to an external environment through an exhaust duct having an exhaust fan, the exhaust hood apparatus comprising:

- a hood positioned over the cooking station; the hood being connected to the exhaust duct through a plenum chamber; the exhaust fan drawing air from the hood and forcing the air to the external environment through the exhaust duct;
- washing means mounted in the plenum chamber;
- a first valve assembly connecting the washing means to a first water source;
- fire detecting means mounted in the hood for detecting uncontrolled fires;
- controller means for controlling the operation of the exhaust hood apparatus; the controller means being electrically connected to at least (a) the exhaust fan, (b) the valve assembly, and (c) the fire detecting means; the controller means being at least so configured as to energize the exhaust fan and to open the first valve assembly, thereby activating the washing means when an uncontrolled fire is detected by the fire detecting means; whereby a portion of the water exiting the washing means is drawn in the exhaust duct through the plenum chamber by the exhaust fan, thereby cooling both the exhaust duct and the plenum chamber.

According to another aspect of the present invention there is provided a controller for controlling the operation of a hood apparatus used at a cooking station for exhausting air containing cooking by-products to an external environment through a plenum chamber connected to an exhaust duct, the controller being electrically connected to at least (a) an exhaust fan mounted to the hood apparatus, (b) a valve assembly supplying water from a first water source to washing means mounted in the plenum chamber and (c) fire detecting means mounted in the hood apparatus; the controller being configured so as to energize the exhaust fan and to open the valve assembly, thereby activating the washing means, when an uncontrolled fire is detected by the fire detecting means; whereby a portion of the water exiting the washing means is drawn in the exhaust duct through the plenum chamber by the exhaust fan thereby cooling both the exhaust duct and the plenum chamber.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

It has been found that it is possible to keep the temperature of the exhaust duct below a temperature determined by safety organizations (usually this temperature is about 190° C.), without using a damper and without mounting water conduits along the entire length of the exhaust duct.

To achieve these results, the present invention uses a controller circuit electrically connected to at least one fire detector, an exhaust fan, and a washing system. The controller is configured so that the exhaust fan and the washing system are activated when the fire detector detects a fire. The cold water exits the washing system through at least one outlet nozzle and produces a stream of small drops of water. Part of the water drops is drawn in the exhaust duct by the exhaust fan and therefore cools the exhaust duct to therefore prevent the temperature to reach the above mentioned flash point. Furthermore, the exhaust fan also draws air from the vicinity of the uncontrolled fire and therefore draws at least some of the smoke generated by this fire.

Figure 1:
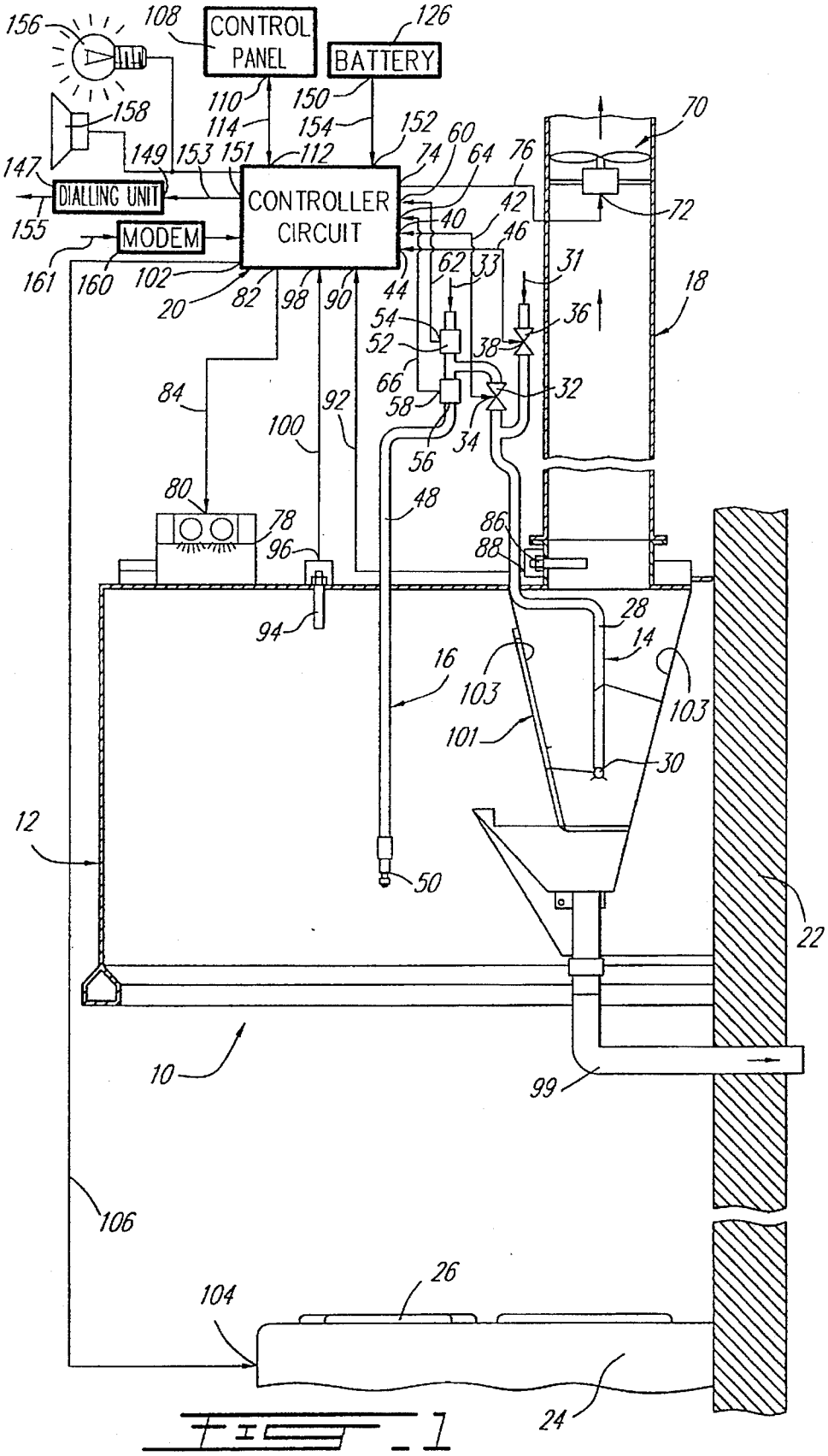
FIG. 1 is a schematic cross-sectional view of an exhaust hood apparatus according to a first embodiment of the present invention.

Turning now to FIG. 1 of the appended drawings, an exhaust hood apparatus 10, according to a first preferred embodiment of the present invention, will be described.

The exhaust hood apparatus 10 includes a hood 12, a washing system 14, a sprinkler system 16, an exhaust duct 18 and a controller circuit 20.

As illustrated in this figure, the hood 12 is adapted to be mounted to a wall 22 over a cooking station 24 including heating elements 26. Heating elements 26 may be electrical heating elements, liquid or gaseous fuel burners, or other types of heating elements. The heating elements 26 are supplied in electricity or fuel through a conventional supply arrangement (not shown).

The washing system 14 includes water conduits 28 to which is mounted a conventional washing nozzle 30. A hot water source (see arrow 31) supplies hot washing water to the water conduits 28 through a solenoid valve 36 having a control input/status output 38.

As illustrated in FIG. 1, the nozzle 30 is mounted in a plenum chamber 101 which prevents the water exiting the nozzle 30 to be projected on the cooking station 24. Furthermore, the internal walls 103 of the plenum chamber 101 collects grease or other particles contained in the cooking by-products, and a drain outlet 99 evacuates the water exiting the nozzle 30 as will be explained hereinafter.

The control input/status output 38 of the solenoid valve 36 is electrically connected to a control output/status input 44 of the controller circuit 20 via an electrical cable 46.

The control input/status output 38 allows the opening and the closing of the solenoid valve 30 by the controller circuit 20 and supplies the status of the solenoid valve 36 to the controller circuit 20.

The controller circuit 20 may therefore initiate a washing cycle by opening the solenoid valve 36.

The sprinkler system 16 includes water conduits 48 to which a conventional sprinkler nozzle 50 is mounted. The water conduits 48 are supplied with cold water from a conventional sprinkler water line (see arrow 33) through a pressure sensor 52 having a data output 54 and a flowmeter 56 having a data output 58.

The data output 54 of the pressure sensor 52 is electrically connected to a data input 60 of the controller circuit 20 via an electrical cable 62. The pressure sensor 52 therefore notifies the controller circuit 20 should the water pressure of the conventional sprinkler water line (see arrow 33) be outside a predetermined pressure range.

Similarly, the data output 58 of the flowmeter 56 is electrically connected to data input 64 of the controller circuit 20 via an electrical cable 66. The flowmeter 56 notifies the controller circuit 20 should the sprinkler system 16 be actuated.

It is to be noted that the water conduits 48 of the sprinkler system 16 are also connected to the water conduits 28 of the washing system 14 through a solenoid valve 32 having a control input/status output 34 which is electrically connected to a control output/status input 40 of the controller circuit 20 via an electrical cable 42.

The control input/status output 34 allows the opening and the closing of the solenoid valve 32 by the controller circuit 20 and supplies the status of the solenoid valve 32 to the controller circuit 20.

It is to be noted that more than one sprinkler nozzle 50 could be used depending of the type of cooking station 24 used.

It is also to be noted that the sprinkler system 16 could be replaced by other types of conventional chemical fire fighting. These systems (not shown) often use electrically or mechanically actuated nozzles to spray the chemical compound on the fire. As will be easily understood to one of ordinary skills in the art, these electrical or mechanical nozzles may be electrically connected to the controller circuit 20 to thereby warn the controller circuit 20 should they be actuated.

The exhaust duct 18 includes an exhaust fan 70 having a control input 72 electrically connected to a control output 74 of the controller circuit 20 via an electrical cable 76. The control input 72 allows the controller circuit 20 to energize and to de-energized the exhaust fan 70. The exhaust fan 70 is mounted so as to draw air from the plenum chamber 101 and to expel this air toward an external environment (not shown) when the exhaust fan 70 is energized.

The hood 12 optionally includes a lighting system 78 having a control input 80 in electrical connection with a control output 82 via an electrical cable 84. The control input 80 allows the opening and the closing of the lighting system 80 by the controller circuit 20.

The hood 12 also includes a first temperature sensor 86 having a temperature output 88 and mounted near the junction of the exhaust duct 18 and the hood 12. The temperature output 88 is in electrical connection with a temperature input 90 of the controller circuit 20 via an electrical cable 92. The controller 20 may therefore monitor the temperature at the junction of the exhaust duct 18 and the hood 12.

The hood 12 also includes a second temperature sensor 94 having a temperature output 96 and mounted to the top portion of the hood 12. The temperature output 96 is in electrical connection with a temperature input 98 of the controller circuit 20 via an electrical cable 100. The controller 20 may therefore monitor the temperature in the hood 12.

As illustrated in FIG. 1, the controller circuit 20 also includes a control output 102 electrically connected to a control input 104 of the cooking station 24 via an electrical cable 106. The control input 104 allows the opening and the closing of the fuel or electricity supply of the cooking station 24 by the controller circuit 20.

A hood control panel 108 including an input/output bus 110 is in electrical connection with an input/output bus 112 of the controller 20 via an electrical cable 114.

Figure 3:
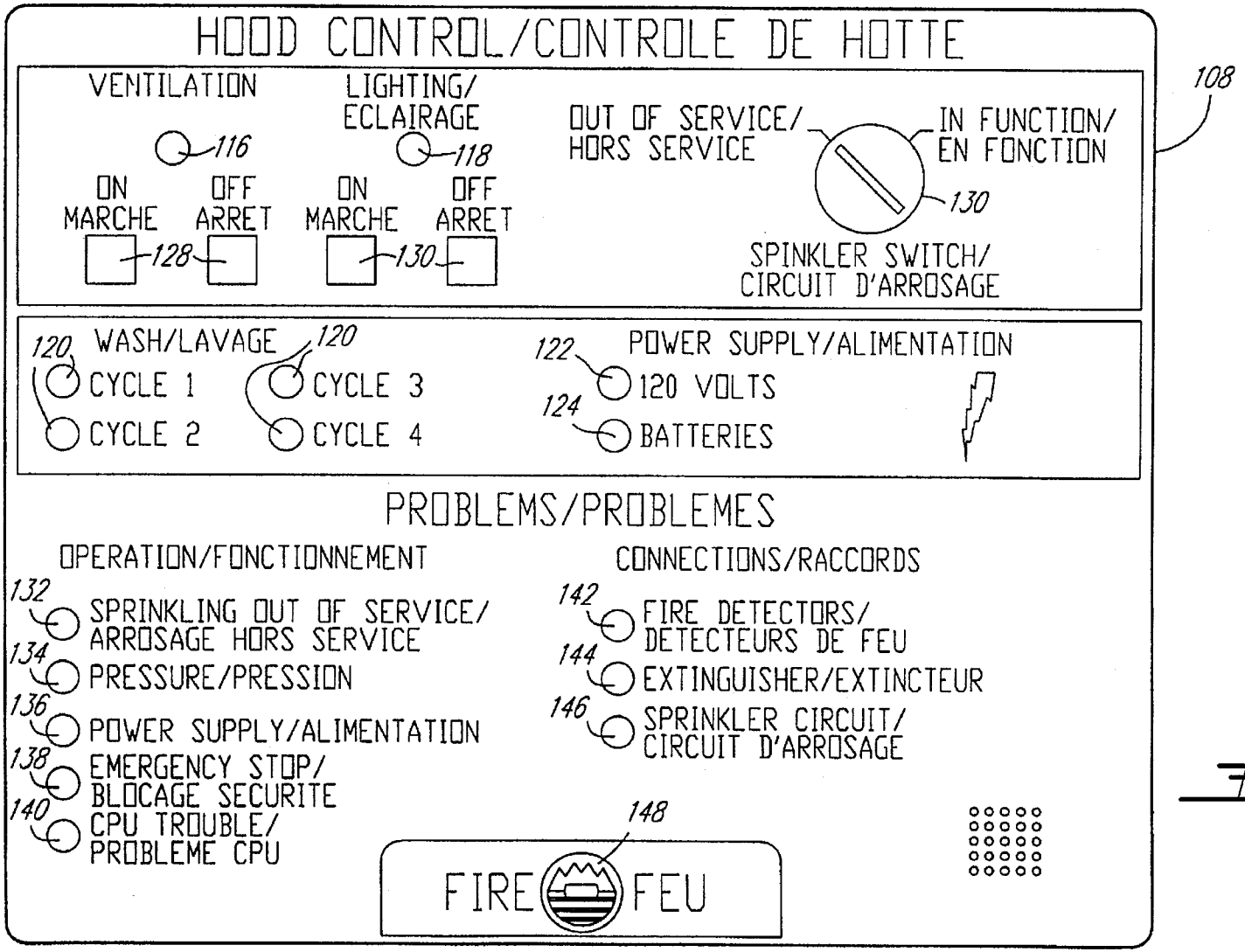
FIG. 3 is a front elevational view of a hood control panel.

FIG. 3 illustrates a possible embodiment of the hood control panel 108. However, it is to be noted that the embodiment of FIG. 3 is given as an example only since many modifications could be done to the hood control panel 108 without modifying the principle of operation of the exhaust hood apparatus of the present invention.

The hood control panel 108 includes a plurality of indicator lights 116–124 electrically connected to the controller circuit via the electrical cable 114. The functions of the indicator lights 116–124 are as follows:

light 116 indicates that the exhaust fan 70 is in operation;

light 118 indicates that the lighting system 78 is in operation;

lights 120 indicates that the washing system 14 is in operation;

light 122 indicates that the exhaust hood apparatus 10 is supplied with electricity through a conventional utility line (not shown); and light 124 indicates that a battery system 126, which will be described hereinafter, supplies the exhaust hood apparatus 10 with electricity; when light 124 is energized it implies that the utility power line (not shown) usually supplying the hood apparatus 10 with electricity is offline.

The hood control panel 108 includes an on/off switch 128 that activates the exhaust fan 70 and an on/off switch 130 that activates the lighting system 78. Furthermore, a key-activated on/off switch is provided to prevent the operation of the sprinkler system 16 should tests be done on other systems of the exhaust hood 10.

The hood control panel 108 also includes a plurality of warning lights 132–146 electrically connected to the controller circuit via the electrical cable 114. The functions of the warning lights 132–146 are as follows:

warning light 132 indicates that the sprinkler system 16 is out of service;

warning light 134 indicates that the pressure sensor 52 detects a water pressure outside a predetermined range;

warning light 136 indicates that a problem exists with the internal alimentation power supply supplying the hood apparatus 10 with electricity;

warning light 138 indicates that the washing system 14 is inoperative;

warning light 140 indicates that the controller circuit 20 is malfunctioning;

warning light 142 indicates that the electrical connection between at least one temperature sensor 86 or 94 is malfunctioning;

warning light 144 indicates that optional fire extinguishers (not shown) are malfunctioning; and warning light 146 indicates that the electrical connection between the controller circuit 20 and the solenoid valve 56 is malfunctioning.

It is to be noted that other types of warning means (not shown) such as, for example, a loudspeaker and/or a blinking light could be used to replace or to complement the warning lights 132–146.

The hood control panel 108 also includes an alarm light 148 which indicates that an uncontrolled fire has been detected by the controller circuit. For example, it may mean that at least one of the temperature sensors 86 and 94 has detected a temperature lying above a predetermined threshold or that the flowmeter 56 has detected the operation of the sprinkler system.

It is to be noted that the control panel 108 may be incorporated with the controller circuit 20 in a single unit (not shown).

Returning now to FIG. 1, the hood apparatus 10 also includes a dialing unit 147 having a control/data input 149 which is electrically connected to a control/data output 151 of the controller circuit 20 via an electrical cable 153. The dialing unit 147 is electrically connected to a conventional telephone line (see arrow 155). The controller 20 may therefore dial a predetermined telephone number and relay a particular message should the controller circuit 20 detect a problem with the hood apparatus 10 or if an uncontrolled fire is detected. Of course, the controller circuit 20 may contain a plurality of telephone numbers and a plurality of messages for particular problems detected.

As previously mentioned, the exhaust hood apparatus 10 also includes a battery system 126 having a power output 150 electrically connected to a power input 152 of the controller circuit 20 via en electrical cable 154. The power input (not shown) of the controller circuit 20 is automatically switched to the battery system 126 should the controller circuit 20 detect a problem with the utility line (not shown) supplying electricity to the exhaust hood apparatus 10.

It is to be noted that the controller circuit 20 may be electrically connected to various conventional alarm means represented by light 156 and loudspeaker 158 in FIG. 1. These alarm means are energized should an uncontrolled fire be detected by the controller circuit 20. Furthermore, the controller circuit 20 may also be electrically connected to a conventional modem 160. If this is the case, the controller 20 may then be accessed through a conventional telephone line (see arrow 161) to thereby allow the remote modification of the configuration of the controller circuit 20 and the remote operation of the hood apparatus 10.

As will be easily understood by someone of ordinary skills in the art, the various components electrically connected to the controller circuit 20, excluding the temperature sensors 86 and 94, the lighting system 78 and the exhaust fan 70, could be incorporated in a single control unit (not shown).

It is to be noted that many other safety devices could be electrically connected to the controller circuit 20 to detect various potentially dangerous situations and allow the controller circuit 20 to react to these situations by emitting warning signals or entering the fire suppression mode. As non limitative examples, smoke sensors, gas leak sensors and/or electrical overloads sensors could be electrically connected to the controller circuit 20.

In operation, switches 128 and 130 are used to respectively energize/stop the exhaust fan 70 and the lighting system 78 when these systems are required in the routine operation of the cooking station 24.

The controller circuit 20 is configured so as to activate the washing system 14, by opening the solenoid valve 36, and therefore initiate a washing cycle at predetermined and programmable intervals. It is believed to be within the reach of one of ordinary skills in the art to determine the duration and frequency of the wash cycles as well as the temperature of the water and the type of detergent used, if any.

If, at any time, (a) one of the temperature sensors 86 and 94 detects a temperature that lies above a predetermined threshold temperature (which may be different for sensor 86 and sensor 94), or (b) the flowmeter 56 detects the operation of the sprinkler system 16, this information is supplied to the controller circuit 20 which enters a fire suppression mode.

When the controller circuit 20 enters in the fire suppression mode, two major systems are activated by the controller circuit 20: the washing system 14, by opening the solenoid valve 32, and the exhaust fan 70.

The washing system 14 therefore sprays cold water through its washing nozzle 30, and the exhaust fan draws air from the hood 12 through the plenum chamber 101 and exhaust it through the exhaust duct 18.

Part of the small drops of cold water exiting the washing nozzle 30 is drawn in the exhaust duct 18 by the exhaust fan 70. Therefore, the water drawn in the exhaust duct 18 cools the exhaust duct 18. The temperature of the air entering the exhaust duct 18 from the plenum chamber 101 is therefore maintained below the above discussed flash point, which prevents the propagation of fire through the exhaust duct 18.

Of course, if the sprinkler system is operating to extinguish the uncontrolled fire, part of the small drops of cold water exiting the sprinkler nozzle 50 is drawn in the exhaust duct 18, through the plenum chamber 101, by the exhaust fan 70, again cooling the exhaust duct 18.

The controller circuit 20 may also initiate several other actions when it enters the fire suppression mode. For example, it may sound an audible alarm through the speaker 158, it may use the dialing unit 147 to contact the fire station, it may close the lighting system 78 to prevent electrical fire hazards and it may close the fuel or electrical supply of the cooking station 24.

As will be easily understood by one of ordinary skills in the art, the battery system 126 will supply the exhaust hood apparatus 10 with electricity should the utility power line (not shown) fail during a fire.

It is to be noted that the controller circuit 20 may be formed by one or a plurality of electronic circuits (not shown) which may include one or a plurality of microprocessors, micro-controllers and/or programmable automation and their associated hardware and software. It is believed to be within the skills of one of ordinary skills in the art of electronics to select the components of the controller circuit 20 and to configure them so as to perform the above-mentioned operations.

Figure 2:
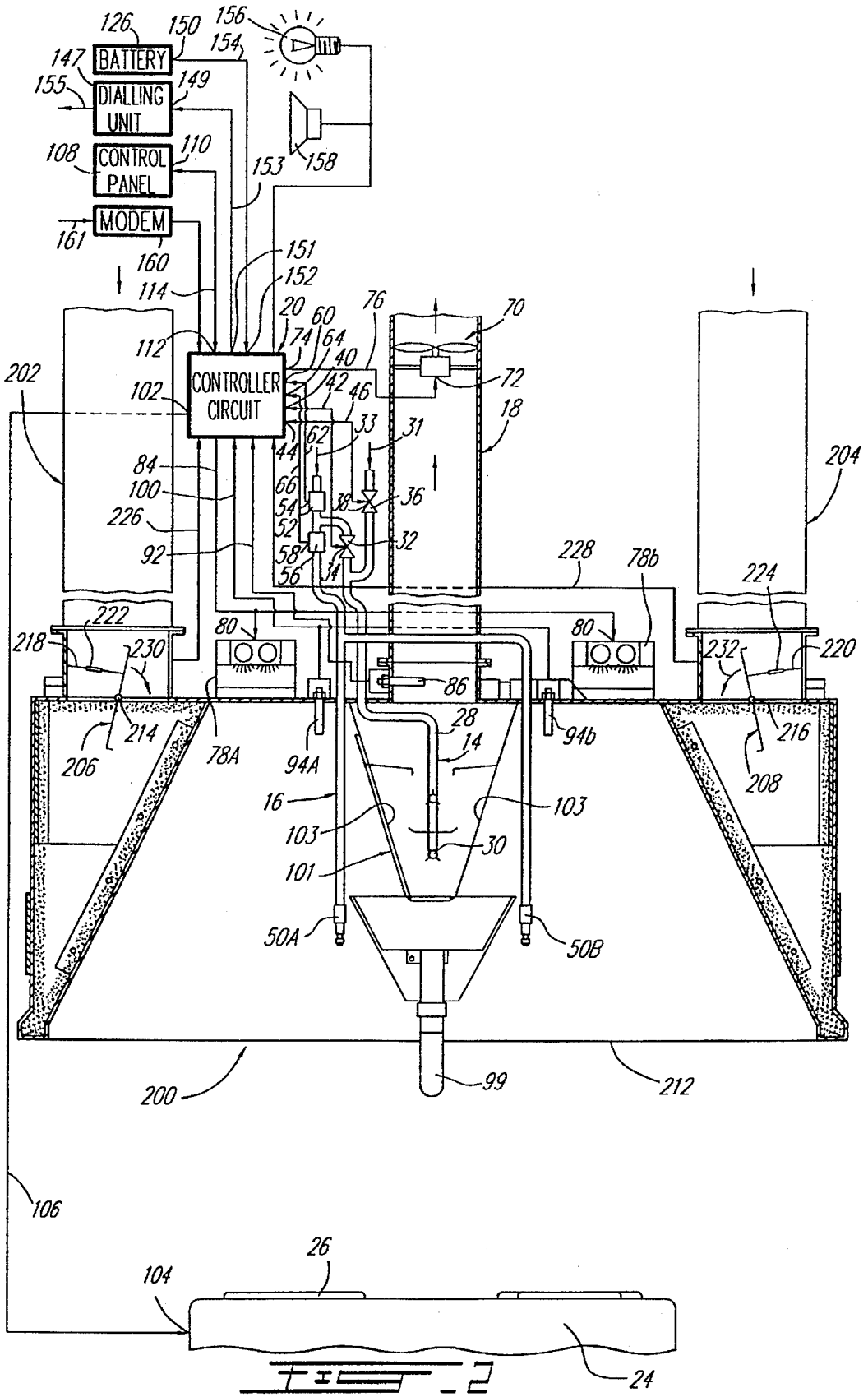
FIG. 2 is a schematic cross-sectional view of an exhaust hood apparatus according to a second embodiment of the present invention.

Turning now to FIG. 2 of the appended drawings, an exhaust hood apparatus 200 according to a second embodiment of the present invention will be described.

Two major differences exist between the exhaust hood apparatus 10 of FIG. 1 and the exhaust hood apparatus 200 of FIG. 2. First, the exhaust hood 200 is adapted to be mounted to a ceiling (not shown) while exhaust hood apparatus 10 is adapted to be mounted to a wall 22. Therefore, since the exhaust duct 18 and the plenum chamber 101 of the hood apparatus 200 are centered, some of the systems are present on both sides of the plenum chamber 101. For example, the lighting systems **78*a*, 78*b*, the temperature sensors 94*a*, 94*b* and the sprinkler nozzles 50*a*, 50*b*. Of course, these systems operate as previously described with respect to FIG. 1**.

The second major difference is the fact that the exhaust hood apparatus 200 includes two air intake ducts 202 and 204. These ducts allow the air to come from the external environment to the exhaust hood 212 to therefore create what is generally known in the art as an air curtain.

Conventional intake ducts 202 and 204 are respectively provided with damper assemblies 206 and 208 which are pivotally mounted to pins 214 and 216, respectively. These damper assemblies 206 and 208 include biasing means (not shown) biasing the dampers 206 and 208 towards a position where the intake ducts 202 and 204, respectively, are closed (see direction arrows 230 and 232). However, lines 218 and 220 respectively maintain the damper assemblies 206 and 208 in an opened position. Heat fuses 222 and 224 mechanically severe the lines 218 and 220 if a predetermined temperature is reached near the heat fuses 222 and 224, thereby closing the dampers 206 and 208 to prevent fire propagation through the intake ducts 202 and 204.

It is to be noted that the damper assemblies 206 and 208 are in electrical connection with the controller circuit 20 via electrical cables 226 and 228, respectively. Therefore, the controller circuit 20 is notified if the air intake ducts 202 and 204 are closed and it may enter the fire suppression mode. This characteristic increases the reliability of the exhaust hood apparatus 200 since it further provides a third mechanism of fire detection. Of course, the first and second mechanisms of fire detection are the temperature sensors 86 and 94, and the sprinkler system 16 and its associated flowmeter 56.

Of course, the control panel 108 of the hood apparatus 200 may include status lights (not shown) which are energized if the dampers 202 and 204 are closed, and warning lights (not shown) which are energized should the electrical connection between the dampers and the controller circuit 20 experience problems.

The other characteristics and elements of the exhaust hood apparatus 200 are similar to the characteristics and elements of the exhaust hood apparatus 10 described hereinabove and therefore will not be repeated herein.

It is to be noted that solenoid valves 32 and 36 could be replaced by any type of valve that may be remotely opened and closed by the controller circuit 20.

The above described exhaust hood apparatuses 10 and 200 have several advantages. For example:

- the configuration of the controller circuit 20 may easily be changed to suit the needs of the owner;
- at least a portion of the smoke generated by the uncontrolled fire is exhausted through the exhaust duct 18;
- the exhaust duct 18 is maintained below the flash point without the need of dampers or conduits along its entire length;
- the battery systems 126 maintains the hood in operation even if the utility power is out; and
- the dialing unit 147 may automatically contact the fire department when a fire condition occurs.

Although the present invention has been described hereinabove by way of preferred embodiments thereof, it can be modified, without departing from the spirit and nature of the subject invention as defined in the appended claims.

What is claimed is:

1. An exhaust hood apparatus for use at a cooking station for exhausting air containing cooking by-products to an external environment through an exhaust duct having an exhaust fan, said exhaust hood apparatus comprising:

a hood positioned over said cooking station; said hood being connected to said exhaust duct through a plenum chamber; said exhaust fan drawing air from said hood and forcing said air to said external environment through said exhaust duct;

washing means mounted in said plenum chamber;

a first valve assembly connecting said washing means to a first water source;

fire detecting means mounted in said hood for detecting uncontrolled fires;

controller means for controlling the operation of the exhaust hood apparatus; said controller means being electrically connected to at least (a) said exhaust fan, (b) said valve assembly, and (c) said fire detecting means; said controller means being at least so configured as to energize said exhaust fan and to open said first valve assembly, thereby activating said washing means when an uncontrolled fire is detected by said fire detecting means; whereby a portion of the water exiting said washing means is drawn in said exhaust duct through said plenum chamber by said exhaust fan, thereby cooling both said exhaust duct and said plenum chamber.

2. An exhaust hood apparatus as defined in claim 1, wherein said fire detecting means include at least one temperature sensor mounted to said hood.

3. An exhaust hood apparatus as defined in claim 2, further comprising a sprinkler system mounted in said hood and connected to said first water source; said fire detecting means further includes flowmeter means mounted between said sprinkler system and said water source; said flowmeter means being in electrical connection with said controller means to signal said controller means should the sprinkler system be actuated, thereby detecting an uncontrolled fire in progress.

4. An exhaust hood apparatus as defined in claim 3, further including (a) a fluid pressure sensor means mounted to said first water source, and (b) warning means; said fluid pressure sensor means and said warning means being electrically connected to said controller means; said controller means being so configured as to activate said warning means when said fluid pressure sensor means detects a fluid pressure lying outside a predetermined pressure range.

5. An exhaust hood apparatus as defined in claim 2, further comprising at least one inlet duct mounted to said hood; said inlet duct comprising a damper to close said inlet duct should the temperature rise above a predetermined threshold; said fire detecting means further including damper closing detecting means electrically connected to said controller means to signal said controller means should the damper close, thereby indicating an uncontrolled fire in progress.

6. An exhaust hood apparatus as defined in claim 2, wherein said fire detecting means further includes at least one temperature sensor mounted in said exhaust duct.

7. An exhaust hood apparatus as defined in claim 1, wherein said washing means is further connected to a second water source through a second valve assembly electrically connected to said controller means; said controller being further so configured as to open said second valve at predetermined and programmable intervals to therefore wash said plenum chamber.

8. An exhaust hood apparatus as defined in claim 1, further comprising alarm means electrically connected to said controller means; and wherein said controller means is further so configured as to activate said alarm means when an uncontrolled fire is detected.

9. An exhaust hood apparatus as defined in claim 1, wherein said controller means includes a dialing unit electrically connected to a telephone line; and wherein said controller means is so configured as to dial at least one predetermined telephone number and relay at least one predetermined message through said dialing unit when an uncontrolled fire is detected.

10. Art exhaust hood apparatus as defined in claim 1, further comprising lighting means mounted in said hood and electrically connected to said controller means; and wherein said controller means is further so configured as to deactivate said lighting means when an uncontrolled fire is detected.

11. An exhaust hood apparatus as defined in claim 1, wherein said controller means is electrically connected to a battery backup system.

12. An exhaust hood apparatus as defined in claim 1, wherein said controller means is electrically connected to an actuator of said cooking station; said controller means being further so configured as to deactivate said cooking station when an uncontrolled fire is detected.

13. An exhaust hood apparatus as defined in claim 1, further comprising a modem electrically connecting said controller means to a conventional telephone line; whereby said controller means may be electrically connected to a computer means to thereby allow the modification of the configuration of said controller means over said telephone line.

14. A controller for controlling the operation of a hood apparatus used at a cooking station for exhausting air containing cooking by-products to an external environment through a plenum chamber connected to an exhaust duct, said controller being electrically connected to at least (a) an exhaust fan mounted to said hood apparatus, (b) a valve assembly supplying water from a first water source to washing means mounted in said plenum chamber and (c) fire detecting means mounted in said hood apparatus; said controller being configured so as to energize said exhaust fan and to open said valve assembly, thereby activating said washing means, when an uncontrolled fire is detected by said fire detecting means; whereby a portion of the water exiting said washing means is drawn in said exhaust duct through said plenum chamber by said exhaust fan thereby cooling both said exhaust duct and said plenum chamber.

15. A controller as defined in claim 14, wherein said fire detecting means include at least one temperature sensor mounted to said hood.

16. A controller as defined in claim 15, further comprising a sprinkler system mounted in said hood and connected to said first water source; said fire detecting means further includes flowmeter means mounted between said sprinkler system and said water source; said flowmeter means being in electrical connection with said controller to signal said controller should the sprinkler system be actuated, thereby detecting an uncontrolled fire in progress.

17. A controller as defined in claim 16, wherein said hood apparatus further includes (a) a fluid pressure sensor means mounted to said first water source, and (b) warning means; said fluid pressure sensor means and said warning means being electrically connected to said controller; said controller being further so configured as to activate said warning means when said fluid pressure sensor means detects a fluid pressure lying outside a predetermined pressure range.

18. A controller as defined in claim 15, wherein said hood apparatus further includes at least one inlet duct; said inlet duct comprising a damper to close said inlet duct should the temperature rise above a predetermined threshold; said fire detecting means further including damper closing detecting means electrically connected to said controller to signal said controller should the damper close, thereby indicating an uncontrolled fire in progress.

19. A controller as defined in claim 15, wherein said fire detecting means further includes at least one temperature sensor mounted in said exhaust duct.

20. A controller as defined in claim 14, wherein said washing means is further connected to a second water source through a second valve assembly electrically connected to said controller; said controller being so configured as to open said second valve at predetermined and programmable intervals to therefore wash said plenum chamber.

21. A controller as defined in claim 14, further comprising alarm means electrically connected to said controller; and wherein said controller is so configured as to activate said alarm means when an uncontrolled fire is detected.

22. A controller as defined in claim 14, further comprising a dialing unit electrically connected to a telephone line; and wherein said controller is so configured as to dial at least one predetermined telephone number and relay at least one predetermined message through said telephone line when an uncontrolled fire is detected.

23. A controller as defined in claim 14, wherein said hood apparatus further comprises lighting means electrically connected to said controller; and wherein said controller is so configured as to deactivate said lighting means when an uncontrolled fire is detected.

24. A controller as defined in claim 14, further comprising a battery backup system electrically connected to said controller.

25. A controller as defined in claim 14, wherein said cooking station includes an actuator electrically connected to said controller; said controller being so configured as to deactivate said cooking station when an uncontrolled fire is detected.

26. A controller as defined in claim 14, further comprising a modem electrically connecting said controller to a conventional telephone line; whereby said controller may be electrically connected to a computer means to thereby allow the modification of the configuration of said controller over said telephone line.

* * * * *